US008689715B2

(12) United States Patent
Plowman et al.

(10) Patent No.: US 8,689,715 B2
(45) Date of Patent: Apr. 8, 2014

(54) ACTUATOR

(75) Inventors: Alistair Plowman, Loanhead (GB); Niall Skinner, Loanhead (GB)

(73) Assignee: MacTaggart, Scott (Holdings) Limited, Midlothian (GB)

( * ) Notice: Subject to any disclaimer, the term of this patent is extended or adjusted under 35 U.S.C. 154(b) by 0 days.

(21) Appl. No.: 12/949,513

(22) Filed: Nov. 18, 2010

(65) Prior Publication Data

US 2011/0114008 A1 May 19, 2011

(30) Foreign Application Priority Data

Nov. 19, 2009 (GB) ..... 0920249.0

(51) Int. Cl.
*B63B 39/06* (2006.01)

(52) U.S. Cl.
USPC ..... 114/126; 114/162

(58) Field of Classification Search
USPC ..... 114/126, 162; 440/56; 49/26
See application file for complete search history.

(56) References Cited

U.S. PATENT DOCUMENTS

| | | | | |
|---|---|---|---|---|
| 4,179,944 | A | 12/1979 | Conner | |
| 4,273,063 | A * | 6/1981 | Berne | 114/126 |
| 4,859,974 | A * | 8/1989 | Kliman et al. | 335/229 |
| 5,529,519 | A * | 6/1996 | Nakamura et al. | 440/61 R |
| 6,002,184 | A * | 12/1999 | Delson et al. | 310/14 |
| 6,088,017 | A * | 7/2000 | Tremblay et al. | 345/156 |
| 6,286,895 | B1 | 9/2001 | Urushiyama et al. | |
| 7,019,421 | B1 | 3/2006 | Hall et al. | |
| 7,063,030 | B2 | 6/2006 | Mizutani | |
| 7,267,069 | B2 | 9/2007 | Mizutani | |
| 7,513,809 | B2 * | 4/2009 | Kubinski | 440/61 T |
| 2006/0028070 | A1 | 2/2006 | Nomaler | |
| 2006/0118590 | A1 * | 6/2006 | Fieffer | 226/177 |
| 2010/0212568 | A1 | 8/2010 | Zanfei | |

FOREIGN PATENT DOCUMENTS

| | | | |
|---|---|---|---|
| DE | 202005005848 | U1 | 8/2006 |
| GB | 2025875 | A | 1/1980 |
| GB | 2456837 | A | 7/2009 |
| JP | 5105193 | | 4/1993 |
| JP | 2004352001 | | 12/2004 |

OTHER PUBLICATIONS

European Search Report mail date Mar. 24, 2011 received for corresponding EP patent application No. 10251946.9-1254.
European Examination Report mail date Nov. 27, 2012 received for corresponding EP patent application No. 10251946.9-1254.

* cited by examiner

*Primary Examiner* — Stephen Avila
(74) *Attorney, Agent, or Firm* — Wong, Cabello, Lutsch, Rutherford & Brucculeri LLP

(57) ABSTRACT

An actuator (10) for use in controlling movement of a component (22) of a seagoing vessel comprises a cylinder (12) for coupling to a vessel hull (14) and an actuator shaft (18). A distal end (20) of the shaft (18) is coupled to the component whose movement is to be controlled and, in use, a control force (Fc) is applied to the shaft (18) to control movement of the shaft (18) from a first position, retracted, position to a second, extended, position. The actuator (10) is compliant in response to an opposing force exceeding a selected force to prevent or mitigate damage to the component (22) and/or the actuator 10 which may otherwise result from the opposing force.

16 Claims, 2 Drawing Sheets

ACTUATOR

CROSS REFERENCE TO RELATED APPLICATION

The present application claims priority to United Kingdom Application 0920249.0 filed on 19 Nov. 2009, the contents of which are incorporated herein by reference.

FIELD OF THE INVENTION

This invention relates to an actuator and, in particular, but not exclusively, to a linear actuator for use in manipulating a control surface of a seagoing vessel.

BACKGROUND OF THE INVENTION

Actuators are used for a variety of functions on seagoing vessels. For example, actuators are used to control the position and/or attitude of a seagoing vessel by manipulation of the vessels control surfaces, including, for example, rudders, tail planes, fore planes, stabilisers and the like. Typically, mechanical or hydraulic actuators are used to manipulate the control surfaces of larger vessels; hydraulic actuators being used, for example, due to their flexibility and the ability to remotely operate the relevant control surface.

Control surfaces in larger vessels may be of significant mass and the actuators must be capable of providing significant force in order to provide precise control over the movement of the control surface, for example, to overcome hydrodynamic forces in moving the control surface against a water flow, wave or the like.

In addition to manipulation of control surfaces, actuators may also be used to deploy and retrieve sensor arrays, telecommunication antennae, mast assemblies or other components or assemblies.

A control surface, component or assembly to be manipulated is often provided in a relatively exposed location on the vessel and it is common that the component will be subject to impacts, for example, from fluid forces or from physical impact of an object.

Furthermore, during operation the control surface, component or assembly may be submerged, or located in another inaccessible location on the vessel, such that damage to a respective component or assembly may severely limit the operational effectiveness of the vessel.

SUMMARY OF THE INVENTION

According to a first aspect of the present invention, there is provided an actuator for use in controlling the movement of a component of a seagoing vessel, the actuator comprising:

an actuation member adapted to be coupled to a component, the movement of which is to be controlled; and a force-generating arrangement for applying a control force to the actuation member, wherein the actuation member is compliant when the component is subject to an opposing force.

Traditionally, actuators provide a mechanical or hydraulic lock such that an opposing force, for example resulting from an impact, is more likely to cause damage to the actuator and/or component such as a control surface. An actuator according to embodiments of the present invention may be adapted to be compliant, that is, to render or yield to the opposing force, thereby substantially eliminating, or at least mitigating, damage to the component and/or the actuator resulting from the opposing force.

The control force may be adapted to move the component, for example, at a desired velocity, distance/stroke or with the required acceleration. Alternatively, the control force may be comprise a holding, or securing, force for controlling movement of the component. For example, where the component to be controlled comprises a control surface of a vessel, the control force may be adapted to move the surface to facilitate control over the direction and/or speed of the vessel.

The opposing force may comprise any force acting against the actuator and may, for example, comprise an impact force. The actuation member may be compliant when it is subject to a predetermined opposing force or where the opposing force exceeds a selected threshold. For example, the threshold may be selected according to the operational requirements of the component, the actuator being configured to overcome or resist a degree of opposing forces, for example, hydrodynamic forces and the like that might be expected during operation. In particular embodiments, the opposing force may result from hydrodynamic forces generated by the passage of fluid over the component, aerodynamic forces such as wind sheer, or from a physical impact, shock load or other engagement.

The actuator may be adapted to apply the control force to the component irrespective of the opposing force. Thus, where the opposing force exceeds the selected force threshold, the actuation member will retreat while still applying the control force. Beneficially, acceleration of the component and actuator may be reduced due to the reduced unbalanced force acting between the opposing forces across the component, thereby further reducing the risk of damage to the component and/or the actuator.

The actuator may be of any suitable form and may, for example, comprise a linear actuator. The actuator may comprise an electric linear actuator, although other forms of actuator may be used, where appropriate. In particular embodiments, the actuation member may be at least partially surrounded by a coil or stator. The actuation member may define or provide mounting for a magnet and may be adapted for linear movement in response to an electro-motive force resulting from current flow in the stator, thereby providing the control force for manipulating the component.

The stator may be coupled to the vessel hull and the actuation member may be configured to define a first, retracted, position relative to the stator/vessel and a second, extended, position. The actuation member may be adapted to move from the first position to the second position under the influence of the control force.

The component to be controlled may comprise any suitable component, including, for example, a vessel control surface, sensor array, telecommunication antenna, mast assembly or any other component or assembly.

The actuator may further comprise a sensor for detecting the forces on the actuation member.

The actuator may further comprise a transmission system for transmitting sensor information to and from a control system. For example, the control system may be adapted to control the current to the stator to assist in mitigating damage to the actuator and the component.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
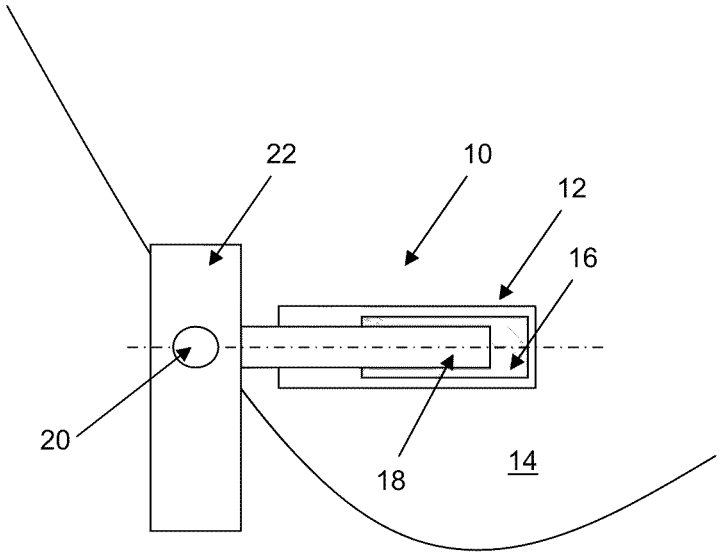
FIG. 1 is a diagram of an actuator according to an embodiment of the present invention, showing the actuator in a first position during normal operation.

Referring initially to FIG. 1 of the drawings, there is shown an actuator 10 according to an embodiment of the present invention. The actuator 10 comprises a cylinder 12 coupled to a vessel hull 14. The cylinder houses a stator in the form of a stator coil 16 and an actuation member in the form of an actuator shaft 18. The shaft 18 is partially enclosed by the stator coil 16, a distal end 20 of the shaft 18 extending out from the cylinder 12. The distal end 20 of the shaft 18 is coupled to a control surface 22 of the vessel 14 such as a rudder, though the distal end 20 may be coupled to any control surface, component or assembly as required.

Figure 2:
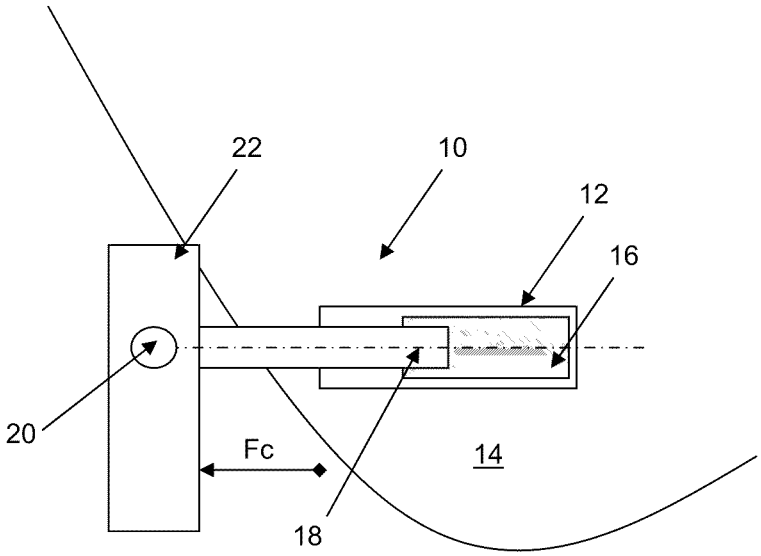
FIG. 2 is a diagram of the actuator of FIG. 1, showing the actuator in a second position during normal operation.

As shown in FIGS. 1 and 2, the shaft 18 initially defines a first, retracted, position relative to the stator 16 (as shown in FIG. 1). In use, an electric current is passed through the stator coil 16, thereby providing an electro-motive control force "Fc" on the shaft 18 to control movement of the shaft 18 from the first position shown in FIG. 1 to a second, extended, position (as shown in FIG. 2). In the embodiment shown in the Figures, movement of the shaft 18 acts to manipulate and control movement of the control surface 22.

In use, the control force "Fc" will overcome opposing forces up to and including a selected threshold, for example, resulting from hydro-dynamic resistance and the like.

Figure 3:
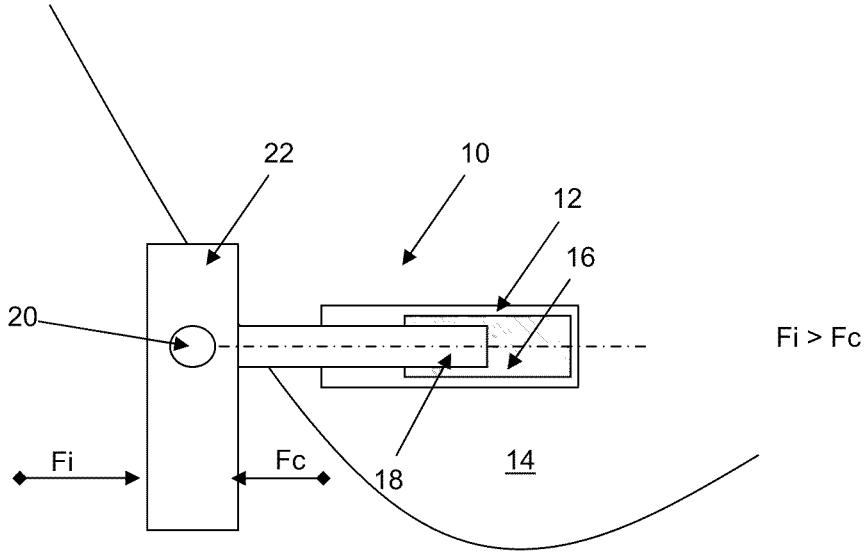
FIG. 3 is a diagram of the actuator of FIGS. 1 and 2, during an impact

Referring now to FIG. 3, where the control surface 22 is subject to an impact force "Fi" which exceeds the selected threshold, the shaft 18 is permitted to render, that is to move from the extended position shown in FIG. 2 towards the retracted position shown in FIG. 1. Providing an actuator 10 which renders in this manner substantially prevents damage to the control surface 22 and the actuator 10 which may otherwise result from the impact force. Furthermore, the acceleration experienced by the shaft 18 as a result of the impact force "Fi" will be lessened by the opposing drive force "Fc", the acceleration "a" being equivalent to the unbalanced force (Fi−Fc) divided by the mass "m" of the actuator 10 and control surface 22.

Figure 4:
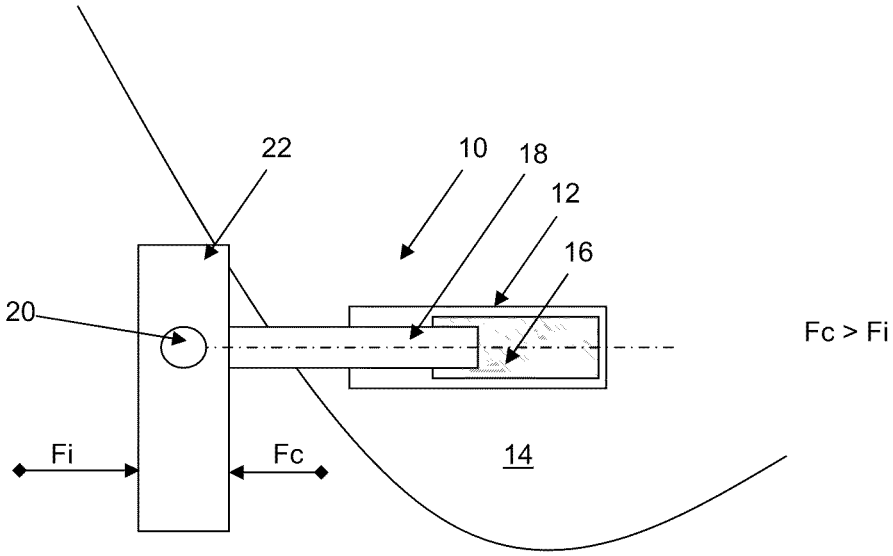
FIG. 4 is a diagram of the actuator of FIGS. 1 to 3, post-impact.

Referring now to FIG. 4, following the impact, the impact force "Fi" reduces below a selected threshold, the control force "Fc" returning the shaft 18 and control surface 22 to the desired position, for example, the second, extended, position shown in FIG. 2.

By reversing the direction of current flow, the control force "Fc" is reversed to return the actuator 10 to the first position.

It should be understood that the embodiments described are merely exemplary of the present invention and that various modifications may be made without departing from the scope of the invention.

For example, as an alternative or in addition to reversing the direction of current flow, the actuator may comprise a return mechanism, such as a spring biasing mechanism to return the shaft to the retracted or parked position. This may function as a fail safe in the event of loss of power to the actuator to prevent damage to the control surface. Alternatively, the actuator may be capable of returning to the first position by gravity or under the under the mass of the control surface and shaft or by any other suitable means

The invention claimed is:

1. An electric linear actuator for use in controlling the movement of a component of a seagoing vessel, the actuator comprising:

an actuation member adapted to be coupled to a component, the movement of which is to be controlled; and a force-generating arrangement for applying a control force to the actuation member to control the movement of the component to be controlled, wherein the actuation member is compliant when the component is subject to an opposing force exceeding a selected force threshold, the actuation member configured to retreat while still applying the control force to eliminate or at least mitigate damage to at least one of the component and the actuator resulting from the opposing force wherein the actuation member is at least partially surrounded by a stator and wherein the actuation member is adapted for linear movement in response to an electro-motive force resulting from current flow in the stator to provide the control force for manipulating the component.

2. The actuator of claim 1, wherein the actuator is configured so that the applied control force moves the component at least one of: a desired distance; at a desired velocity; and at a desired acceleration.

3. The actuator of claim 1, wherein the control force comprises a holding, or securing, force.

4. The actuator of claim 1, wherein the component to be controlled comprises a control surface of a vessel.

5. The actuator of claim 1, wherein the opposing force comprises at least one of: an impact force acting against the actuator; a hydrodynamic force; an aerodynamic force; a wind shear load; and a shock load.

6. The actuator of claim 1, wherein the actuator is adapted to apply the control force to the component irrespective of the opposing force.

7. The actuator of claim 1, wherein the stator is coupled to a vessel hull.

8. The actuator of claim 1, wherein the actuation member defines or provides mounting for a magnet.

9. The actuator of claim 1, wherein the actuation member is configured to define a first, retracted, position relative to a vessel and a second, extended, position.

10. The actuator of claim 9, wherein the actuation member is adapted to move from the first position to the second position under the influence of the control force.

11. The actuator of claim 1, wherein the component to be controlled is selected from the group consisting of a vessel control surface, sensor array, telecommunication antenna, mast assembly.

12. The actuator of claim 1, further comprising a sensor for detecting the forces on the actuation member.

13. The actuator of claim 1, further comprising a control system.

14. A method of for use in controlling the movement of a component of a seagoing vessel, the method comprising:

coupling an actuation member to a component, the movement of which is to be controlled; and applying a control force to the actuation member to control the movement of the component to be controlled, wherein the actuation member is compliant when the component is subject to an opposing force exceeding a selected threshold, the actuation member configured to retreat while still applying the control force to eliminate or at least mitigate damage to at least one of the component and the actuator resulting from the opposing force, wherein the actuation member is at least partially surrounded by a stator and wherein the actuation member is adapted for linear movement in response to an electromotive force resulting from current flow in the stator to provide the control force for manipulating the component.

15. The actuator of claim 13, wherein the control system is adapted to control the current to the stator.

16. An actuator for use in controlling the movement of a component of a seagoing vessel, the actuator comprising:

an actuation member adapted to be coupled to a component, the movement of which is to be controlled, wherein the actuation member is at least partially surrounded by a stator;

a force-generating arrangement for applying a control force to the actuation member to control the movement of the component to be controlled, wherein the actuation member is compliant when the component is subject to an opposing force exceeding a selected force threshold, the actuation member configured to retreat while still applying the control force to eliminate or at least mitigate damage to at least one of the component and the actuator resulting from the opposing force; and a control system, wherein the control system is adapted to control the current to the stator.

* * * * *